US010463166B2

(12) United States Patent
Richardson

(10) Patent No.: US 10,463,166 B2
(45) Date of Patent: Nov. 5, 2019

(54) INTENSIVE USE MATTRESS

(71) Applicant: Jed Richardson, Batavia, IL (US)

(72) Inventor: Jed Richardson, Batavia, IL (US)

(73) Assignee: The Norix Group, West Chicago, IL (US)

( * ) Notice: Subject to any disclaimer, the term of this patent is extended or adjusted under 35 U.S.C. 154(b) by 504 days.

(21) Appl. No.: 15/092,211

(22) Filed: Apr. 6, 2016

(65) Prior Publication Data

US 2017/0290439 A1 Oct. 12, 2017

(51) Int. Cl.
*A47C 31/00* (2006.01)
*A47C 27/08* (2006.01)

(52) U.S. Cl.
CPC ..... *A47C 27/088* (2013.01)

(58) Field of Classification Search
CPC ..... A47C 31/00
USPC ..... 5/716, 721, 644
See application file for complete search history.

(56) References Cited

U.S. PATENT DOCUMENTS 1,970,754 A * 8/1934 Myers ..... A61F 5/48 119/527
2,750,606 A * 6/1956 Freedlander ..... A47G 9/10 428/68
2,822,554 A * 2/1958 Wenzelberger ..... A47C 27/081 5/644
D325,840 S * 5/1992 Main ..... A47C 31/00 D6/601
2008/0216231 A1* 9/2008 Lambarth ..... A61G 7/1026 5/81.1 HS

* cited by examiner

*Primary Examiner* — Fredrick C Conley
(74) *Attorney, Agent, or Firm* — Applied Patent Services, PC; James D Palmatier

(57) ABSTRACT

A molded mattress having a one piece seamless cover with a ventilation plug mounted in a tamper resistant recess formed surrounding a ventilation hole. The one piece seamless cover may have a plurality of airways formed in the cover to allow air circulation between the user and the mattress cover. The one piece seamless cover is integrally rotomolded to form a rugged comfortable mattress for intensive use environments. An RFID communication chip may be inserted in the cover for information management. The cover may be formed from solid color, translucent or transparent material.

18 Claims, 9 Drawing Sheets

FIG. 4
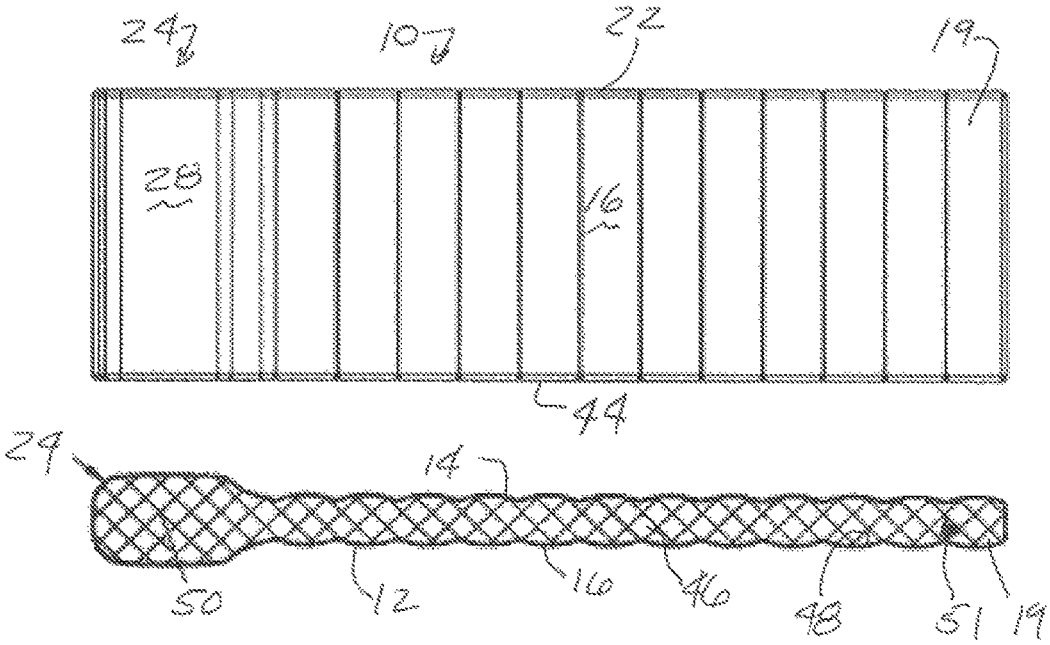
FIG. 5
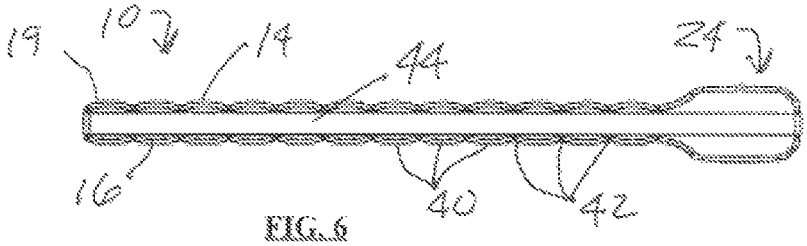
FIG. 6
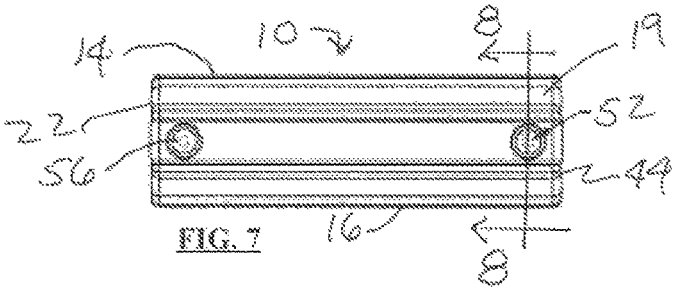
FIG. 7

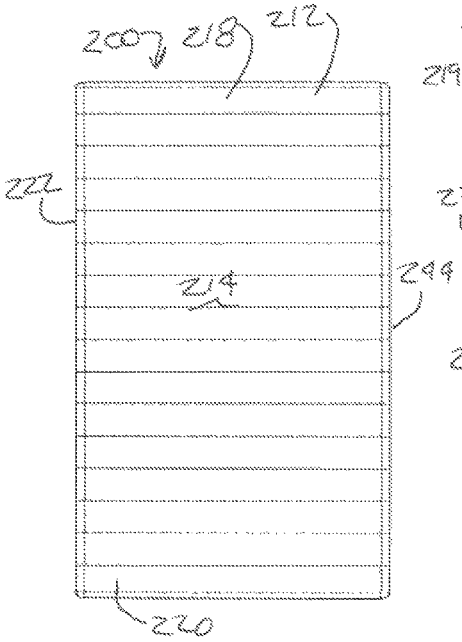
FIG. 16
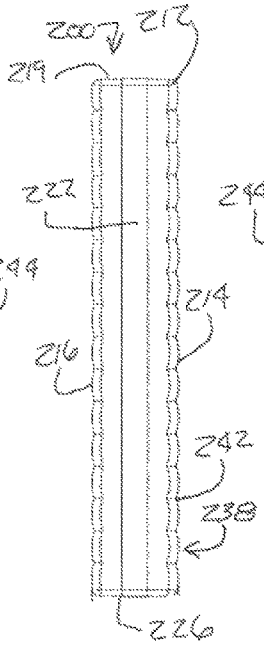
FIG. 17
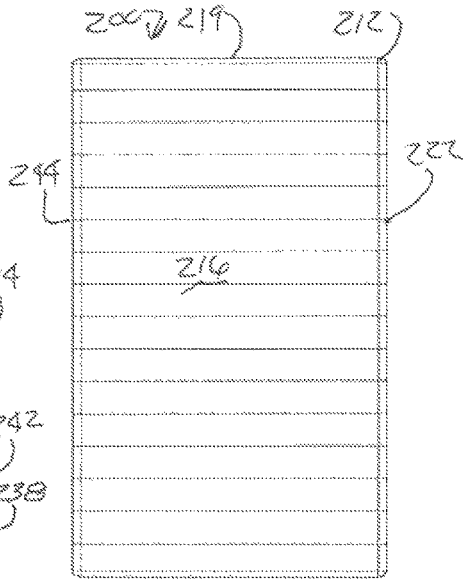
FIG. 18
FIG. 19
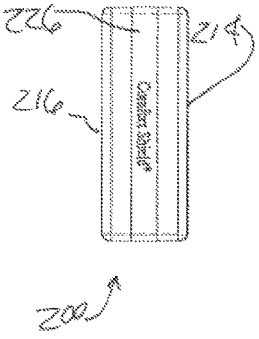
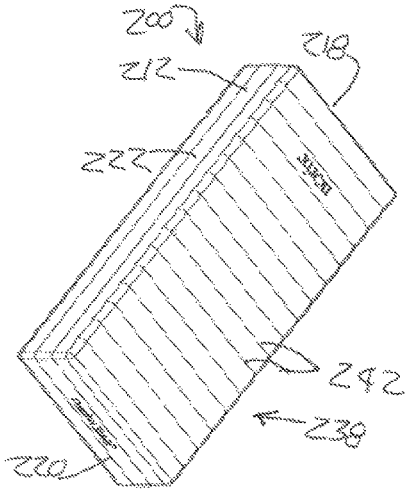
FIG. 21

INTENSIVE USE MATTRESS

FIELD OF THE INVENTION

The present invention relates to intensive use furniture specifically a one piece molded mattress for use in intensive use environments as a sleeping surface.

BACKGROUND OF THE INVENTION

The present invention relates to a one piece molded mattress having no seams, no stitches and no strings used in the assembly. The one piece molded cover may be provided with a filtered vent to allow air to escape to prevent ballooning when a user lies on the mattress. Sealed seam mattresses have been used for air beds, camping mattresses, water floats and beds where hygienic contamination is a concern. Traditionally, sealed seam mattresses have a resilient inner mattress pad formed of a fibrous material or foam, depending on the environment and building regulations. A cover is formed over the pad by wrapping a sheet of material around the pad and welding or sealing the edges to surround the pad. Prior art mattresses teach attaching the material by stitching, seams or strings to hold the mattress cover around the pad.

The prior art teaches placing a pillow on the mattress inside the cover or attached to a covered mattress. The prior art teaches the pillow may be layered on the mattress pad at one end or may be disposed adjacent the head end. The prior art further teaches disposing the pillow on the top side of the mattress or using a sleeve to connect the pillow to the mattress pad. The pad is then covered with a sheet material that is welded on the seams to seal the pad therein.

Prior art seamed or welded mattresses may be adapted with ventilation to allow air exchange between the inside of the mattress cover and the ambient air. The opening may cause issues in an intensive use environments. In intensive use environments, furniture and fixtures must be tamper resistant to prevent hiding contraband and creating loose pieces of material. The ventilation plug must be secured to prevent its removal and use as a weapon or contraband. Further, the ventilation hole must be covered to prevent insertion of contraband for hiding in the mattress cover.

Further, prior art plastic mattresses do not allow air circulation between the user and the cover. This lack of air circulation makes the use of the prior art mattress hot and uncomfortable for the user to lie on for long periods. Lack of air circulation between the plastic cover and the user's body may also cause sweating or irritation.

Accordingly, it is desirable to provide a one piece molded mattress cover that is molded without seams or stitches and filled with a resilient foam to provide support. The one piece molded mattress cover may have a plurality of air channels formed on the surface and a ventilation plug that is recessed into the body of the mattress and fixed there I a tamper resistant attachment to prevent removal.

SUMMARY OF THE INVENTION

The present invention may comprise a one piece molded mattress comprising a molded hollow seamless cover having a top, bottom surfaces, and an inside cavity and outside skin. The top having a corrugated top outside surface forming a plurality of air circulation channels along the surface of the mattress cover. A vent hole in the molded cover extending from the inside to the outside and adapted to receive a ventilation plug. The vent hole having a recess configured to receive an outer perimeter edge of a ventilation plug. The ventilation plug having an outer lip that snaps into the recess whereby the outer lip of the ventilation plug is captured inside the ventilation hole recess.

The ventilation plug may be fixed in the vent hole using an adhesive, welding or the like. The ventilation plug may have an plug inside surface, a plug outside surface, a plug perimeter wall and a plurality of vent apertures extending through the plug from the plug outside surface to the plug inside surface. The plug perimeter wall extends between the plug inside surface and the plug outside surface. The apertures formed in the plug or provided by a screen material over the vent hole held in place by the ventilation plug to prevent the travel of organisms and contraband into the one piece molded mattress cover. An edge between the plug perimeter wall and the plug outside surface is completely covered when the plug is fixed in the recess to make the attachment tamper resistant by not providing access to the plug perimeter wall from the ventilation hole.

The one piece molded mattress cover may be rotomolded to provide a seamless hollow construction having side walls, end walls and a top and bottom surfaces. The side walls, end walls and a top and bottom surfaces are integrally molded together to form a seamless one piece molded mattress cover. A hollow inside cavity in the one piece molded mattress cover is filled with foam for support. The foam material may be inserted into the hollow cavity at the ventilation hole thereby filling the hollow cover and urging the one piece mattress to retain a shape. The foam material filling the one piece molded mattress cover to provide support for the user. The foam filling also resisting the insertion of contraband into the mattress cover.

The shape of the one piece molded mattress cover may be molded to provide pillow arrangement at a head end. Drainage holes or peripheral drainage retention may be formed integral to the cover. The one piece molded mattress cover may have support portions adapted to support a users shoulders, hips or knees. The one piece molded mattress cover may be flat, undulated or wedge shaped depending on the user requirements.

The above description sets forth, rather broadly, a summary of one embodiment of the present invention so that the detailed description that follows may be better understood and contributions of the present invention to the art may be better appreciated. Some of the embodiments of the present invention may not include all of the features or characteristics listed in the above summary. There are, of course, additional features of the invention that will be described below and will form the subject matter of claims. In this respect, before explaining at least one preferred embodiment of the invention in detail, it is to be understood that the invention is not limited in its application to the details of the construction and to the arrangement of the components set forth in the following description or as illustrated in the drawings. The invention is capable of other embodiments and of being practiced and carried out in various ways. Also, it is to be understood that the phraseology and terminology employed herein are for the purpose of description and should not be regarded as limiting.

BRIEF DESCRIPTION OF THE DRAWINGS

FIG. 4 is a bottom plan view of the first embodiment of the one piece molded mattress.

FIG. 5 is a section view taken at approximately 5-5 of FIG. 3 of the of a first embodiment of the one piece molded mattress.

FIG. 6 is an opposite side elevation view of the first embodiment of the one piece molded mattress of FIG. 1.

FIG. 7 is a head end elevation view of the first embodiment of the one piece molded mattress.

FIG. 16 is a bottom plan view of view of a third embodiment of the one piece molded mattress.

FIG. 17 is a top plan view of the third embodiment of the one piece molded mattress.

FIG. 18 is a foot end elevation view of the third embodiment of the one piece molded mattress.

FIG. 19 is a perspective view of the third embodiment of the one piece molded mattress.

DETAILED DESCRIPTION OF THE INVENTION

In the following detailed description of the preferred embodiments, reference is made to the accompanying drawings, which form a part of this application. The drawings show, by way of illustration, specific embodiments in which the invention may be practiced. It is to be understood that other embodiments may be utilized and structural changes may be made without departing from the scope of the present invention.

Figure 1:
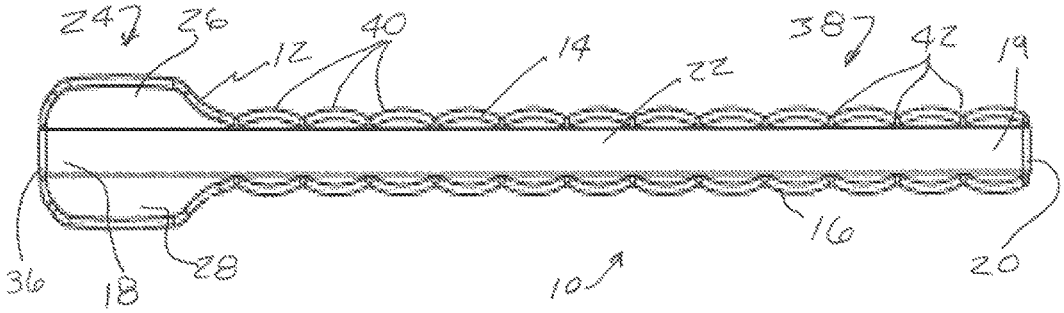
FIG. 1 is a side elevation view of a first embodiment of the one piece seamless molded mattress.
Figure 2:
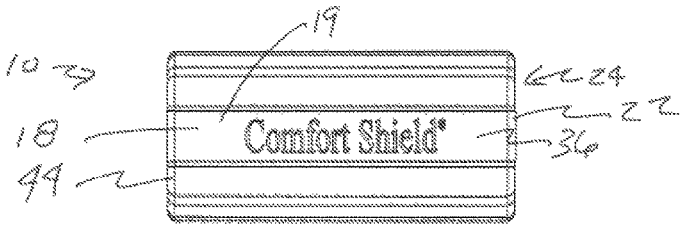
FIG. 2. is a foot end elevation view of a first embodiment of the one piece molded mattress.
Figure 3:
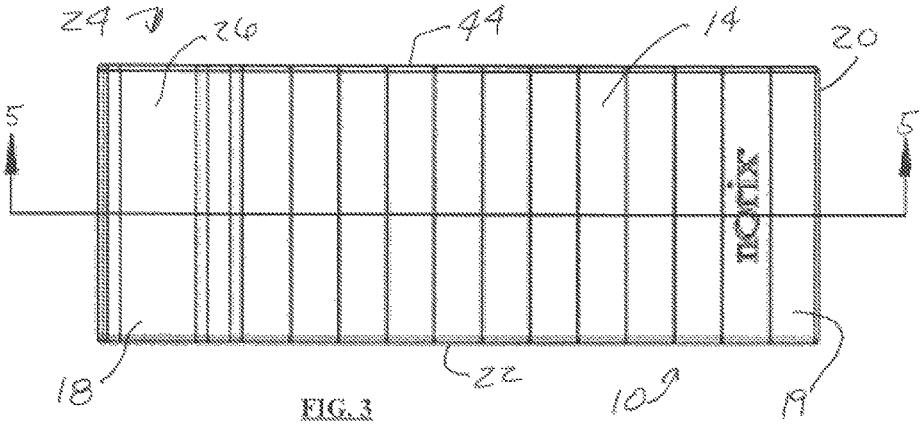
FIG. 3 is a top plan view of the first embodiment of the one piece molded mattress.

The present invention comprises a one piece molded mattress having a cover formed by plastic molding without stitching, seams or strings to hold the mattress together. Referring to FIG. 1, the one piece molded mattress referred to generally by the numeral 10 comprises a one piece molded seamless cover 12 having a mattress top surface 14, a mattress bottom surface 16, a head end 18, a foot end 19, a foot end wall 20, a first side wall 22 and a pillow portion 24. The one piece molded cover 12 may be formed of plastic having a color or transparent or translucent quality. Where the cover 12 is transparent contraband (not shown) hidden in the mattress cover 12 may be visible. The pillow portion 24 may further comprise a top pillow 26 and a bottom pillow 28. The top surface 14 and bottom surface 16 may have a corrugated design 38 comprising a plurality of ridges 40 and troughs 42 formed therein.

Referring to FIGS. 2, 3, 4 and 6, head end 18 may comprise a top pillow surface 32, a bottom pillow surface 34 and a head end wall 36. The mattress cover 12 may further comprise a second side wall 44. The corrugated surface 38 may dispose the ridges 40 and troughs 42 to extend from the first side wall 22 to the second side wall 44. Pillow portion 24 may be integrally molded adjacent the head end 18 on mattress top surface 14. Foot end wall 20 may join the mattress top surface 14 and mattress bottom surface 16. Side wall 22 is attached to mattress top surface 14 and mattress bottom surface 16. Head end 18 may comprise head end wall 19 joining mattress top surface 14 and mattress bottom surface 16.

Referring to FIG. 5, the one piece molded cover 12 may be hollow having an inside cavity 46 defined by inner surface 48. A foam material 50 may be inserted into the one piece molded cover 12. The foam material 50 may fill the inside cavity 46 including the pillow portion 24. An identification RFID chip 51 may be inserted in foam material 50 in the inside cavity 46.

Referring to FIG. 7, the foot end wall 20 may have a ventilation hole 52 formed therein. The ventilation hole 52 may have a ventilation plug 56 fixed therein. The foam material 50 (FIG. 5) may be sprayed or poured into the inside cavity 46 through the ventilation hole 52. The ventilation hole 52 may be sealed by the ventilation plug 56.

Figure 8:
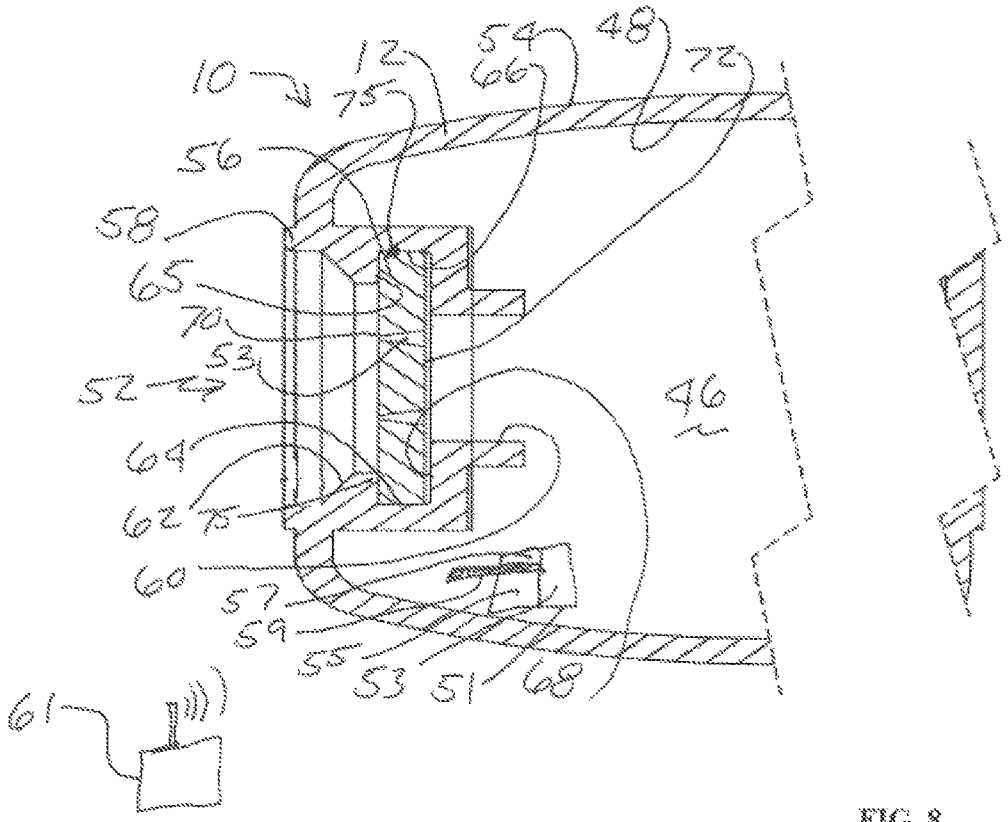
FIG. 8 is a section view of the one piece molded mattress illustrating the attached ventilation plug taken at approximately 7-7 of FIG. 6.
Figure 9:
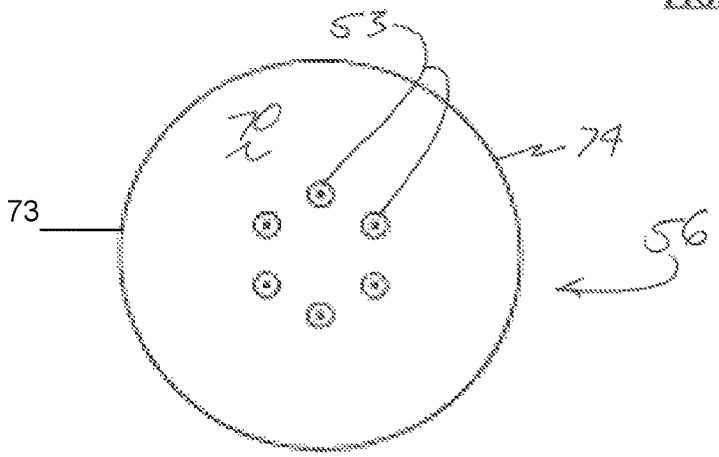
FIG. 9 is a top plan view of the ventilation plug.

Referring to FIGS. 8 and 9, ventilation plug 56 is fixed in ventilation hole 52. The ventilation hole 52 extends from the outer surface 54 of the molded cover 12 to the inner surface 48. Ventilation hole 52 may have a lip 58 surrounding opening 60 and a sloping shoulder 62 extending from lip 58 into inside cavity 46. Plug recess 64 is formed surrounding opening 60. Plug recess 64 has a recess outside surface 65, a recess landing 66 and a recess inside surface 68. Ventilation plug 56 has a plug outside surface 70, a plug inside surface 72 and a plug perimeter wall 74. Plug perimeter wall 74 is attached to and extends from plug outside surface 72 at outside plug edge 73. Plug perimeter wall 74 may have a circular shape with a diameter sized to bear against the landing 66. Sloping shoulder 62 has a diameter smaller than plug perimeter wall 74. Sloping shoulder 62 is formed integrally in the one piece molded cover 12 and may deform when ventilation plug 56 is inserted therein to allow ventilation plug 56 to seat in the plug recess 64. Ventilation plug 56 is adapted and sized to snap into plug recess 64 having ventilation plug outside surface 70 bear against recess outside surface 65. Ventilation plug 56 is further adapted to snap into plug recess 64 having ventilation plug inside surface 72 bear against recess inside surface 68. Sloping shoulder 62 extends over and covers ventilation plug perimeter wall 74 at overlap 75 when ventilation plug 56 is in ventilation hole 52 whereby the plug perimeter wall 74 is surrounded by the plug recess 64 having edge 73 in recess 64 and covered by sloping shoulder 62 at overlap 75. Ventilation plug 56 may have ventilation holes 53 formed therein by cutting or drilling or molding to allow air passage through ventilation holes 53. Ventilation plug 56 may be fixed in the ventilation hole 52 using an adhesive 75 or welding similar permanent attachment. RFID chip 51 may inserted adjacent ventilation plug 56. RFID chip 51 may have memory 53, a transmitter 55, a receiver 57 and an antenna 59. Memory 53 may have storage of identification information such as date of service, location assignment, personnel assignment and manufacturing information. The RFID chip 61 adapted for wireless communication to a communication portal 61.

Figure 10:
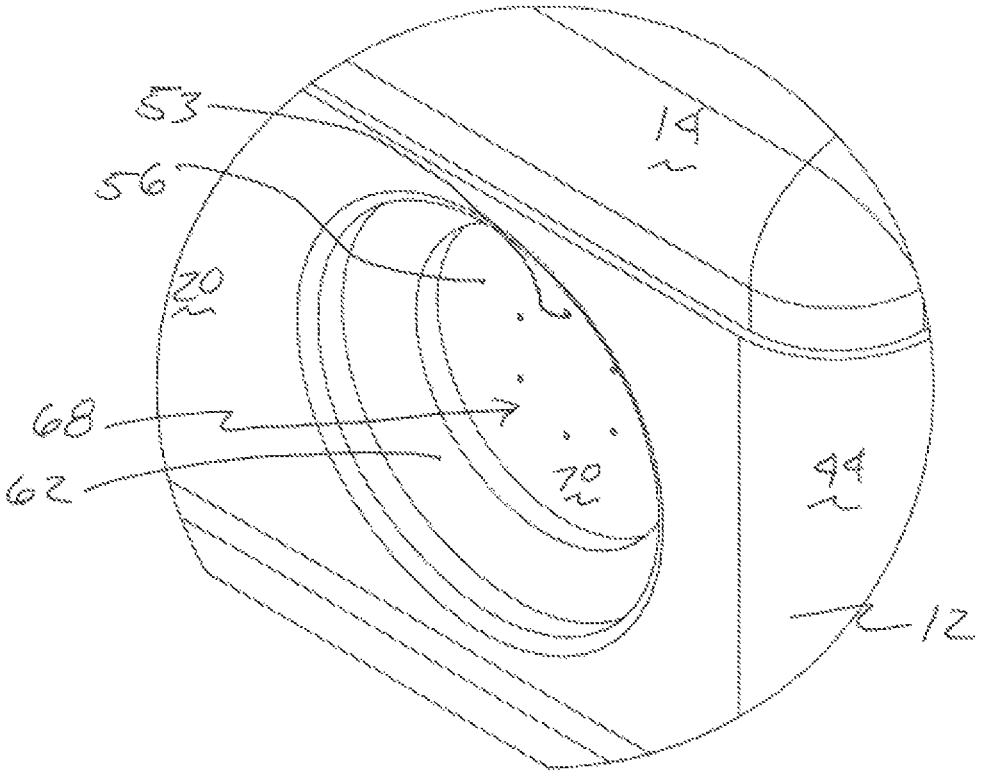
FIG. 10 is a perspective view of the ventilation plug in the ventilation hole in the one piece molded mattress
Figure 11:
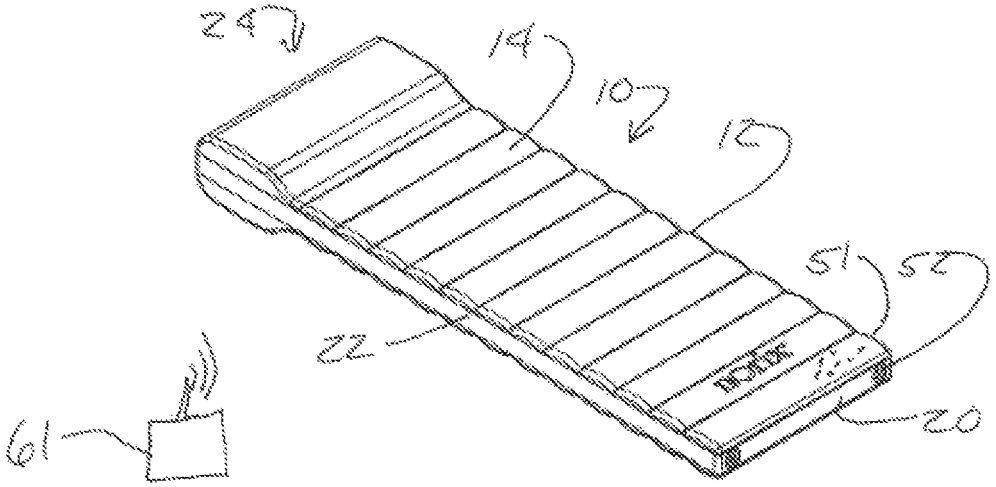
FIG. 11 is a perspective view of the first embodiment of the one piece molded mattress.
Figure 12:
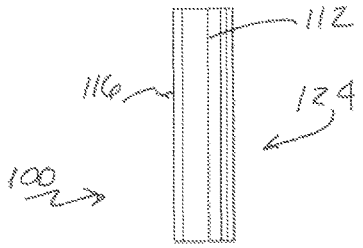
FIG. 12 is a foot end elevation view of a second embodiment of the one piece molded mattress.
Figure 13:
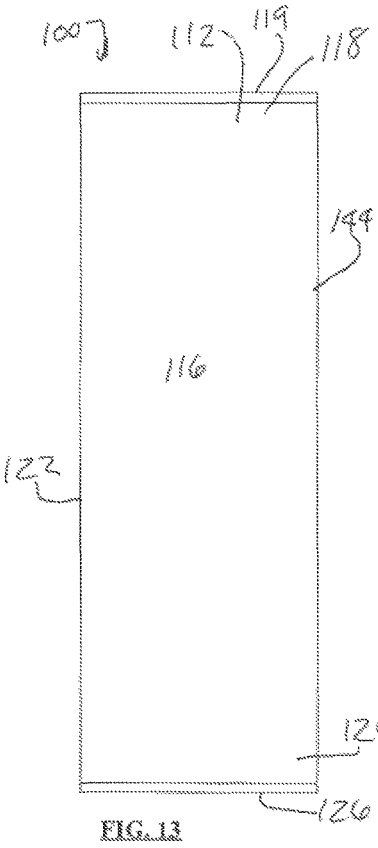
FIG. 13 is a bottom plan view of the second embodiment of the one piece molded mattress.
Figure 14:
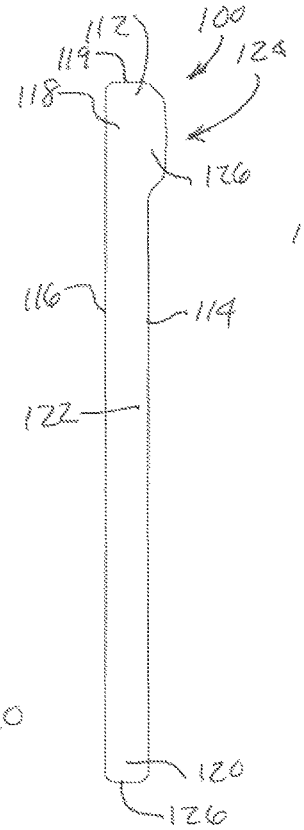
FIG. 14 is a side elevation view of the second embodiment of the one piece molded mattress.
Figure 15:
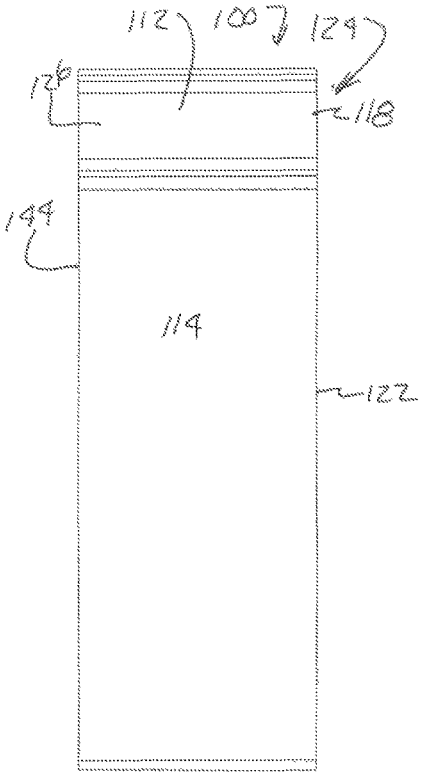
FIG. 15 is a top plan view of the second embodiment of the one piece molded mattress.
Figures 20, 26:
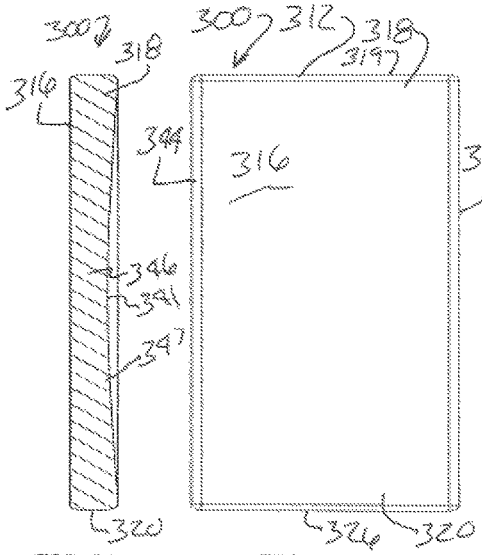
FIG. 20 is a bottom plan view of a fourth embodiment of the one piece molded mattress.
FIG. 26 is a section view taken at approximately 26-26 of FIG. 22 of the fourth embodiment of the one piece molded mattress.
Figure 21:
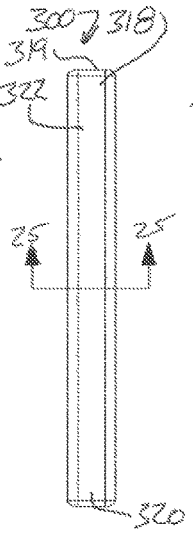
FIG. 21 is a side elevation view of the fourth embodiment of the one piece molded mattress
Figure 22:
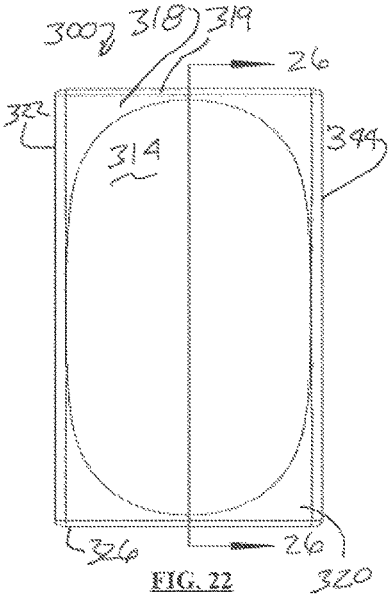
FIG. 22 is a top plan view of the fourth embodiment of the one piece molded mattress.
Figure 27:
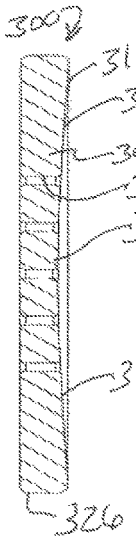
FIG. 27 is a section view taken at approximately 27-27 of FIG. 24 of the fifth embodiment of the one piece molded mattress.
Figure 23:
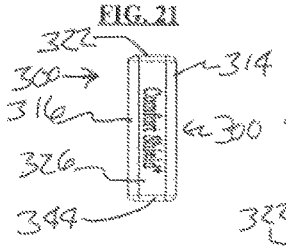
FIG. 23 is a foot end elevation view of the fourth embodiment of the one piece molded mattress.
Figure 25:
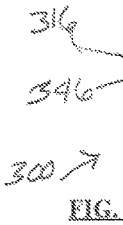
FIG. 25 is a section view taken at approximately 25-25 of FIG. 21 of the fourth embodiment of the one piece molded mattress.
Figure 24:
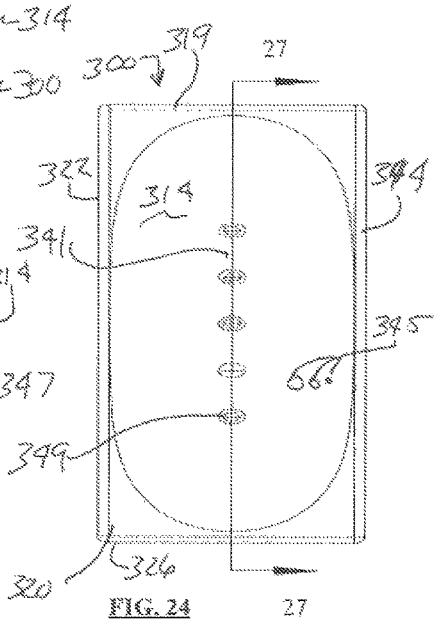
FIG. 24 is a top plan view of a fifth embodiment of the one piece molded mattress.
Figure 34:
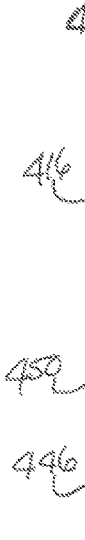
FIG. 34 is a section view taken at approximately 34-34 of FIG. 30 of the sixth embodiment of the one piece molded mattress.
Figure 28:
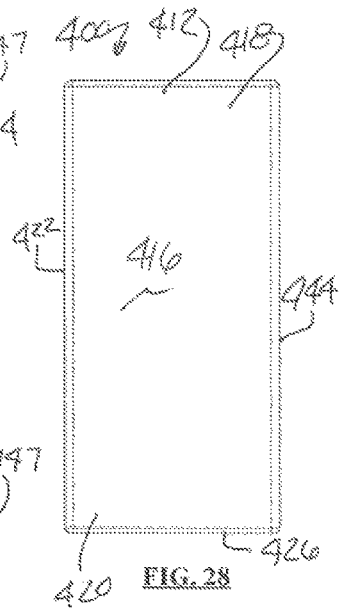
FIG. 28 is a bottom plan view of a sixth embodiment of the one piece molded mattress.
Figure 29:
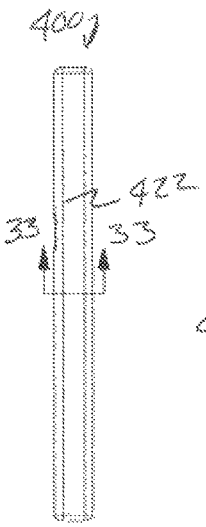
FIG. 29 is a side elevation view of the sixth embodiment of the one piece molded mattress
Figure 30:
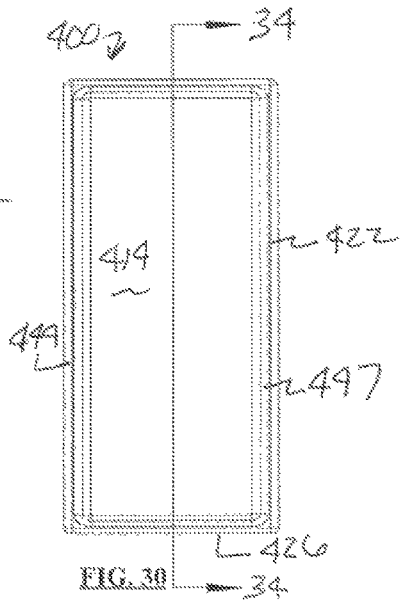
FIG. 30 is a top plan view of the sixth embodiment of the one piece molded mattress.
Figure 31:
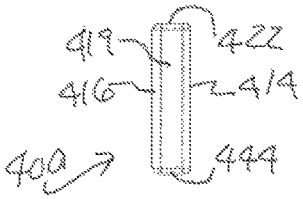
FIG. 31 is a foot end elevation view of the sixth embodiment of the one piece molded mattress.
Figure 33:
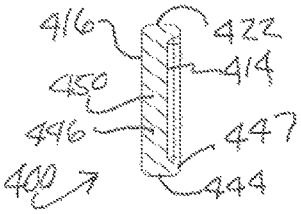
FIG. 33 is a section view taken at approximately 33-33 of FIG. 29 of the sixth embodiment of the one piece molded mattress.
Figure 32:
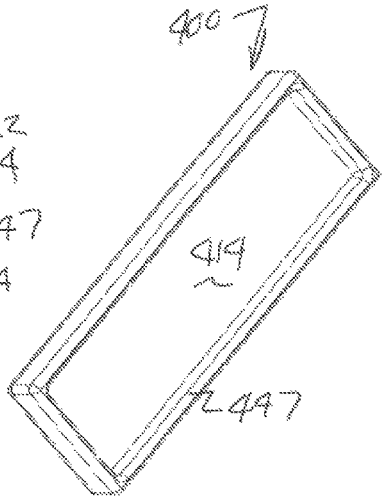
FIG. 32 is a perspective view of the sixth embodiment of the one piece molded mattress.

Referring to FIGS. 10 and 11, ventilation plug 56 may be mounted in ventilation hole 52 having sloping shoulder 62 extending over ventilation plug 56 perimeter wall 74. Ventilation plug outside surface 70 may be recessed into the inside cavity 46 from the outer surface 54 of the molded one piece cover 12. One piece molded mattress 10 may have a plurality of ventilation holes 52 formed therein.

Referring to FIGS. 12-15, a second embodiment of the one piece molded mattress 100 may comprise a one piece molded cover 112 having a mattress top surface 114, a mattress bottom surface 116, a head end 118, a foot end 120, a first side wall 122, a second side wall 144 and a pillow portion 124. The pillow portion 124 may further comprise a single pillow 126 integrally molded adjacent the head end 118 on mattress top surface 114. Foot end 120 may comprise a foot end wall 126 joining the mattress top surface 114 and mattress bottom surface 116. Side wall 122 is attached to mattress top surface 114 and mattress bottom surface 116. Head end 118 may comprise head end wall 119 joining mattress top surface 114 and mattress bottom surface 116.

Referring to FIGS. 16-19, the one piece molded mattress 200 may comprise a one piece molded cover 212 having a mattress top surface 214, a mattress bottom surface 216, a head end 218, a foot end 220, and a first side wall 222 and second side wall 244. Foot end 220 may comprise a foot end wall 226 joining the mattress top surface 214 and mattress bottom surface 216. Side walls 222, 244 are attached to mattress top surface 214 and mattress bottom surface 216. Head end 218 may comprise head end wall 219 joining mattress top surface 214 and mattress bottom surface 216 to form inside cavity 246. The top surface 214 and bottom surface 216 may have a corrugated design 238 comprising a plurality of air circulation indentations 242 formed therein. The one piece molded mattress cover 212 may further comprise a second side wall 244. The corrugated surface 238 may dispose the air circulation indentations 242 extending from first side wall 222 to second side wall 244.

Referring to FIGS. 20-27, the one piece molded mattress 300 may comprise a one piece molded cover 312 having a sloped mattress top surface 314, a mattress bottom surface 316, a head end 318, a foot end 320, and a first side wall 322 and second sidewall 344. Foot end 320 may comprise a foot end wall 326 joining the mattress top surface 314 and mattress bottom surface 316. Side walls 322, 344 are attached to sloped mattress top surface 314 and mattress bottom surface 316. Head end 318 may comprise head end wall 319 joining sloped mattress top surface 314 and mattress bottom surface 316 to form inside cavity 346. The sloped top surface 314 may have a liquid retention slope 347 surrounding the sloped mattress top surface 314. Drainage holes 349 may be formed at sloped mattress top apex 341 approximately midway between side walls 322, 344 extending from the mattress top surface 314 to mattress bottom surface 316. Liquid retention slope 347 is formed higher at the side walls 322, 344 and lower at drainage holes 349 allowing gravity to urge liquid 345 to migrate from sidewalls 322, 344 toward drainage holes 349. Likewise, liquid retention slope 347 is higher at the foot end wall 326 and head end wall 319 and lower at drainage holes 349 allowing gravity to urge liquid 345 to migrate to drainage holes 349.

Referring to FIGS. 28-34, the one piece molded mattress 400 may comprise a one piece molded cover 412 having a surrounded mattress top surface 414, a mattress bottom surface 416, a head end 418, a foot end 420, and a first side wall 422 and second sidewall 444. Foot end 420 may comprise a foot end wall 426 joining the surrounded mattress top surface 414 and mattress bottom surface 416. Side walls 422, 444 are attached to surrounded mattress top surface 414 and mattress bottom surface 416. Head end 418 may comprise head end wall 419 joining surrounded mattress top surface 414 and mattress bottom surface 416 to form inside cavity 446. The surrounded mattress top surface 414 may have a liquid retention lip 447 surrounding the mattress top surface 414. Liquid retention lip 447 extends upward as an extension of first and second side walls 422, 444 and, head end wall 419 and foot end wall 426. Foam material 450 may be inserted inside the a one piece molded cover 412 to fill the inside cavity 446.

Figure 35:
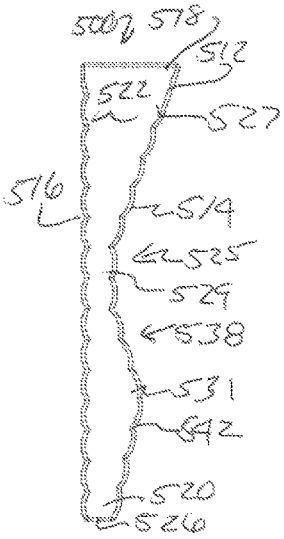
FIG. 35 is a side elevation view of a seventh embodiment of the one piece molded mattress.
Figure 36:
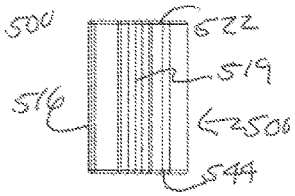
FIG. 36 is a foot end elevation view of the seventh embodiment of the one piece molded mattress.
Figure 37:
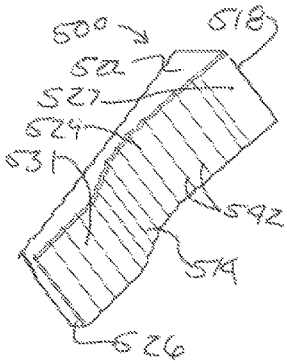
FIG. 37 is a perspective view of the seventh embodiment of the one piece molded mattress.

Referring to FIGS. 35-37, the one piece undulated molded mattress 500 may comprise a one piece molded cover 512 having a undulated mattress top surface 514, a mattress bottom surface 516, a head end 518, a foot end 520 and a first side wall 522 and second sidewall 544. Foot end 520 may comprise a foot end wall 526 joining the mattress top surface 514 and mattress bottom surface 516. Side walls 522, 544 are attached to undulated mattress top surface 514 and mattress bottom surface 516. Head end 518 may comprise head end wall 519 joining mattress top surface 514 and mattress bottom surface 516. Top surface 524 may have an undulating shape 525 wherein a head portion 527 is higher relative to the bottom surface 516 than a hip portion 529. A knee portion 531 may be elevated higher than hip portion 529 with respect to bottom surface 516. The undulated top surface 514 may have a corrugated design 538 comprising a plurality of air passages 542 formed therein. The corrugated surface 538 may dispose the air passages 542 extending from first side wall 522 to second side wall 544.

Figure 38:
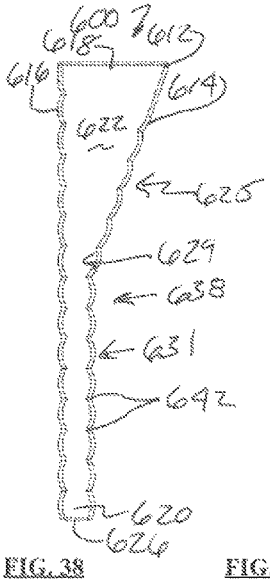
FIG. 38 is a side elevation view of an eighth embodiment of the one piece molded mattress.
Figure 41:
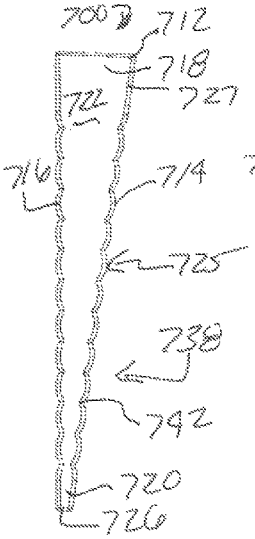
FIG. 41 is a side elevation view of a ninth embodiment of the one piece molded mattress.
Figure 44:
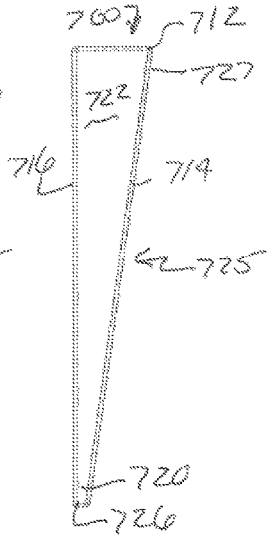
FIG. 44 is a side elevation view of a tenth embodiment of the one piece molded mattress.
Figure 39:
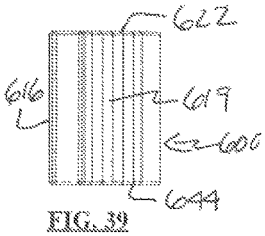
FIG. 39 is a foot end elevation view of the eighth embodiment of the one piece molded mattress.
Figure 42:
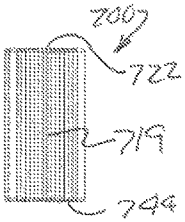
FIG. 42 is a foot end elevation view of the ninth embodiment of the one piece molded mattress.
Figure 45:
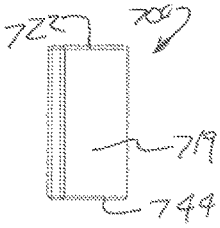
FIG. 45 is a foot end elevation view of the tenth embodiment of the one piece molded mattress.
Figure 40:
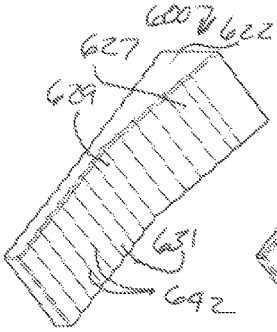
FIG. 40 is a perspective view of the eighth embodiment of the one piece molded mattress.
Figure 43:
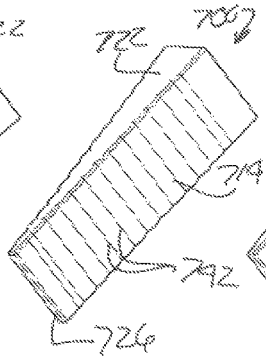
FIG. 43 is a perspective view of the ninth embodiment of the one piece molded mattress.
Figure 46:
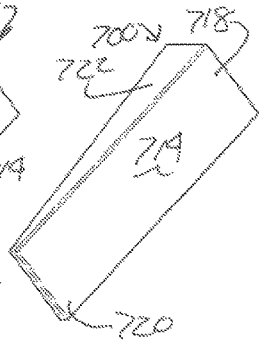
FIG. 46 is a perspective view of the tenth embodiment of the one piece molded mattress.

Referring to FIGS. 38-40, the one piece molded mattress 600 may comprise a one piece molded cover 612 having a mattress top surface 614, a mattress bottom surface 616, a head end 618, a foot end 620 and a first side wall 622 and second sidewall 644. Foot end 620 may comprise a foot end wall 626 joining the mattress top surface 614 and mattress bottom surface 616. Side walls 622, 644 are attached to mattress top surface 614 and mattress bottom surface 616. Head end 618 may comprise head end wall 619 joining mattress top surface 614 and mattress bottom surface 616. one piece molded mattress 600 may have an upright shape 625 wherein head portion 627 is higher relative to the bottom surface 616 with mattress top surface sloping downward from a head portion to hip portion 629. Hip portion, knee portion 631 and foot end portion 620 are at the same elevation with respect to mattress bottom surface 616. may be elevated higher than hip portion 629 with respect to bottom surface 616. The top surface 614 may have a corrugated design 638 comprising a plurality of air passages 642 formed therein. The corrugated surface 638 may dispose the air passages 642 extending from first side wall 622 to second side wall 644.

Referring to FIGS. 41-46, one piece molded mattress 700 may comprise a one piece wedge shaped molded cover 712 having a mattress top surface 714, a mattress bottom surface 716, a head end 718, a foot end 720 and a first side wall 722 and second sidewall 744. Foot end 720 may comprise a foot end wall 726 joining the mattress top surface 714 and mattress bottom surface 716. Side walls 722, 744 are attached to mattress top surface 714 and mattress bottom surface 716. Head end 718 may comprise head end wall 719 joining mattress top surface 714 and mattress bottom surface 716. Wedge shaped one piece molded mattress cover 712 may have a wedge shape 725 wherein a head portion 727 is higher relative to bottom surface 716 than foot end 720. Top surface 714 may have a wavy design 738 comprising a plurality of airways 742 formed therein. The wavy design surface 738 may dispose the airways 742 extending from first side wall 722 to second side wall 744.

While the invention has been described with reference to exemplary embodiments, it should be understood by those skilled in the art that various changes may be made and equivalents may be substituted for elements thereof without departing from the scope of the invention. For example, certain ranges, limits, settings, and other such parameters may be modified to further implement the teachings herein. In addition, many modifications may be made to adapt a particular situation or substance to the teachings of the invention without departing from the scope thereof.

The invention claimed is:

1. A molded mattress comprising:

a one piece, seamless vented cover, the vented cover comprising a top, a bottom, a first side wall, a second side wall, an inner surface, an outer surface and a inside cavity; and an air passage in the vented cover, the top comprising a top surface, the air passage extending from the inside cavity to the outer surface wherein the air passage further comprises a cover ventilation hole in the vented cover and a ventilation plug in the cover ventilation hole, the ventilation plug comprising a plug inside surface, a plug outside surface and a plug perimeter, a plug ventilation hole in the ventilation plug, the plug ventilation hole extending from the plug outside surface to the plug inside surface, the plug ventilation hole in communication with the inside cavity, the cover ventilation hole comprising a vent opening in the outside surface, a lip, a sloping shoulder, and a plug recess, the lip on the outer surface, the lip surrounding the vent opening, the sloping shoulder on the lip surrounding the air passage, the sloping shoulder extending between the lip and the plug recess, the plug recess comprising a recess inside surface, a recess outside surface and a recess landing, the plug recess surrounding the air passage between the sloping shoulder and the inside cavity, the recess landing between the recess outside surface and the recess inside surface, the ventilation plug in the plug recess having the plug perimeter on the recess landing, the plug outside surface on the recess outside surface and the plug inside surface on the recess inside surface, the ventilation plug on the one piece, seamless, vented cover.

2. The molded mattress of claim 1, wherein the one piece, seamless vented cover further comprises a mattress top surface having a corrugated outside surface.

3. The molded mattress of claim 2, wherein the corrugated outside surface further comprises a plurality of airways formed in the mattress top surface, each adjacent pair of the plurality of airways separated by a ridge, the corrugated outside surface spaced from the pillow portion, the plurality of airways extending from the first side to the second side.

4. The molded mattress of claim 2, wherein the one piece, seamless vented cover further comprises a sloped mattress top surface.

5. The molded mattress of claim 4, further comprising drainage holes in the vented cover, the drainage holes extending from the top surface to the bottom.

6. The molded mattress of claim 1 wherein the ventilation plug perimeter further comprises an outside plug edge in the recess, the sloping shoulder covering the outside plug edge.

7. The molded mattress of claim 1, wherein the one piece, seamless, vented cover further comprises a head end, a foot end, a first side and a second side, a first side wall on the first side, a second side wall on the second side, a foot wall on the foot end and a head wall on the head end, the head wall seamlessly attached to the mattress top surface at the head end and seamlessly attached to the mattress bottom surface at the head end, the mattress top surface and bottom surface in spaced relation at the head end, the head wall extending from the mattress top surface to the mattress bottom surface, the head wall seamlessly attached to the first side wall, the head wall seamlessly attached to the second side wall, the first side wall in spaced relation to the second side wall, the head wall extending from the first side wall to the second side wall, the first side wall seamlessly attached to the mattress top surface at the first side, the first side wall seamlessly attached to the mattress bottom surface at the first side, the mattress top surface and bottom surface in spaced relation adjacent the first side, the first side wall extending from the mattress top surface to the mattress bottom surface, the second side wall seamlessly attached to the mattress top surface at the second side, the second side wall seamlessly attached to the mattress bottom surface at the second side, the mattress top surface and bottom surface in spaced relation adjacent the second side, the second side wall extending from the mattress top surface to the mattress bottom surface, the foot wall seamlessly attached to the mattress top surface at the foot end, the foot wall seamlessly attached to the mattress bottom surface at the foot end, the mattress top surface and bottom surface in spaced relation at the foot end, the foot wall extending from the mattress top surface to the mattress bottom surface, the foot wall seamlessly attached to the first side wall adjacent the first side, the foot wall seamlessly attached to the second side wall adjacent the second side wall, the first side wall in spaced relation to the second side wall at the foot end.

8. The molded mattress of claim 7, further comprising a foam material in the inside cavity, the foam material in the pillow portion.

9. The molded mattress of claim 1, further comprising a lip on the vented cover, the lip surrounding the top surface.

10. The molded mattress of claim 9, wherein the top is sloped away from the lip.

11. A molded matress comprising:

a one piece, seamless vented cover, the vented cover comprising a top, a bottom, a first side wall, a second side wall, an inner surface, an outer surface and an inside cavity, the top further comprising a plurality of air passages formed in the mattress outer surface, the plurality of air passages comprises a plurality of ridges, each adjacent pair of ridges separated by a trough, the ridges and troughs extending across the mattress top surface, the air passages spaced from the pillow portion; and an air passage in the vented cover, the top comprising a top surface, the air passage extending from the inside cavity to the outer surface.

12. The molded mattress of claim 11, the one piece, seamless vented cover further comprising an RFID chip in the inside cavity, foam in the inside cavity, the RFID chip in the foam.

13. The molded mattress of claim 12, further comprising a communication portal in wireless communication with the RFID chip.

14. The molded mattress of claim 11, wherein the one piece, seamless molded cover is transparent whereby contraband hidden in the mattress cover may be visible.

15. The molded mattress of claim 11, further comprising drainage holes in the vented cover, the drainage holes extending from the top surface to the bottom.

16. The molded mattress of claim 15 further comprising a drainage hole in the vented cover, the drainage hole extending from the inside cavity to the bottom, the wherein the sloped top is disposed to form an inside cavity in the top.

17. A molded mattress comprising:

a one piece, seamless, vented cover, the one piece, seamless, vented cover having an outside, an inside cavity, a mattress top surface, a cover ventilation hole, a plurality of airways formed in the mattress top surface, and a pillow portion, the plurality of airways extending across the mattress top surface, the cover ventilation hole in the one piece, seamless, molded cover extending through the cover from the outside to the inside cavity, the cover ventilation hole having an opening and a recess, the recess surrounding the opening, the recess having an inside recess wall, an outside recess wall and a landing; and a ventilation plug, the ventilation plug in the recess, the ventilation plug comprising a plug outside wall on the outside recess wall, a plug inside wall on the inside recess wall and a plug perimeter wall on the landing.

18. The molded mattress of claim 17, further comprising a liquid retention lip on the top, the liquid retention lip surrounding the top surface.

* * * * *